United States Patent [19]

Ebner

[11] 4,099,618

[45] Jul. 11, 1978

[54] PROTECTIVE CONTAINER FOR FONT DISC SEGMENTS

[75] Inventor: Peter R. Ebner, S. Nashua, N.H.

[73] Assignee: Itek Corporation, Lexington, Mass.

[21] Appl. No.: 675,663

[22] Filed: Apr. 12, 1976

[51] Int. Cl.[2] ..... B65D 85/48

[52] U.S. Cl. ..... 206/454; 206/451; 206/486; 206/270; 220/435

[58] Field of Search ..... 215/227, 231; 220/352, 220/356; 150/.5; 229/14 C; 206/.82, 409, 454–456, 451, 486

[56] References Cited

U.S. PATENT DOCUMENTS

| | | | |
|---|---|---|---|
| 2,246,642 | 6/1941 | Stachowiak | 206/270 |
| 2,808,925 | 10/1957 | O'Rielly | 206/.82 |
| 2,983,467 | 5/1961 | Retherford | 206/409 |
| 3,214,012 | 10/1965 | Mack | 220/352 |
| 3,854,579 | 12/1974 | Scharre | 229/14 C |

*Primary Examiner*—William Price
*Assistant Examiner*—Douglas B. Farrow
*Attorney, Agent, or Firm*—Homer O. Blair; Robert L. Nathans; Gerald H. Glanzman

[57] ABSTRACT

A protective container for font disc segments. The container includes a housing portion for supporting the segment and a cap portion for closing the housing portion and, at the same time, for locking the segment against movement within the housing portion. More particularly, the housing portion includes an inner casing supported within an outer casing with the inner casing being of relatively flexible material and having side wall portions extending beyond the top opening in said outer casing. After insertion of the segment into the inner casing, the cap portion is placed around the extended wall portions of said inner casing and, in doing so, will not only close the container, but will also force the walls of the inner casing inwardly against the segment to positively lock it against movement. Upon removal of the cap portion, the side walls of the inner casing will spring outwardly to release the segment for easy removal from the housing.

11 Claims, 3 Drawing Figures

PROTECTIVE CONTAINER FOR FONT DISC SEGMENTS

BACKGROUND OF THE INVENTION

1. Field of the Invention

The present invention relates generally to a protective package for fragile or delicate objects. More specifically, the present invention relates to a container for use in shipping and handling font disc segments for phototypesetters.

2. Description of the Prior Art

Phototypesetting systems employ discs of plastic or glass to contain the fonts or other indicia to be projected onto an image receiving medium. A single font disc may contain several different fonts, and, as a result, it is believed desirable to manufacture the disc in sections, for example, four quadrants, which may be interchanged by the user in accordance with his particular requirements. For example, a typical user may find it necessary or desirable to maintain an inventory of disc segments which he can insert or remove from the phototypesetter as needed.

Although this interchangeability feature provides the phototypesetter with substantial flexibility, it also creates obvious handling problems because of the fragile and delicate nature of the disc segments. Care should be taken to minimize the possibility of chipping or scratching the segment surface or of otherwise contaminating it, both during storage and handling. Accordingly, some suitable container is needed to store and transport the segment, and although a variety of containers for fragile articles are known in the prior art, none have been found to be fully adequate for the special problems of font segments.

BRIEF SUMMARY OF THE INVENTION

By the present invention, an improved container for storing and transporting font disc segments has been provided. In accordance with a preferred embodiment, this container or package comprises a housing portion adapted to receive the segment, and a cap or closure portion adapted to close the housing and, at the same time, to lock the segment rigidly within the housing so that it will be unable to shift or move around. The housing portion includes an outer casing and an inner casing supported within it. The inner casing is adapted to receive the segment disc and is of relatively flexible material capable of being deflected. The inner casing is also slightly longer than the outer casing and thus has wall portions which extend outwardly through the top opening of the outer casing. The cap portion is designed to fit over this extended wall portion of the inner casing to close the housing.

The container is used as follows: with the cap removed, the font segment is inserted into the inner casing and will fit into it easily with a positive clearance fit to minimize its rubbing against the side walls of the casing. The cap portion is then inserted over the extended wall portions of the inner casing and, in doing so, the cap wall press the inner casing walls inwardly into firm contact with the disc segment. This will positively lock the segment into position within the casing and prevent it from moving or otherwise shifting around during storage and shipment. Upon removal of the cap, the inner casing will spring back to release the disc to permit it to be easily removed.

As a further aspect of the invention, the housing portion is sized such that a small section of the disc will extend above it when the cap is removed. Thus, only this portion of the segment can be touched in removing it from the casing. This will tend to prevent the user from touching the indicia-containing areas of the segment and thus help protect it.

In general, the container of the present invention is quite simple in design, yet is highly effective in protecting the segment against damage during both handling and storage. Yet further features of the invention will be set forth in greater detail hereinafter in conjunction with the detailed description of the preferred embodiments.

DETAILED DESCRIPTION OF THE PREFERRED EMBODIMENT

Figure 1:
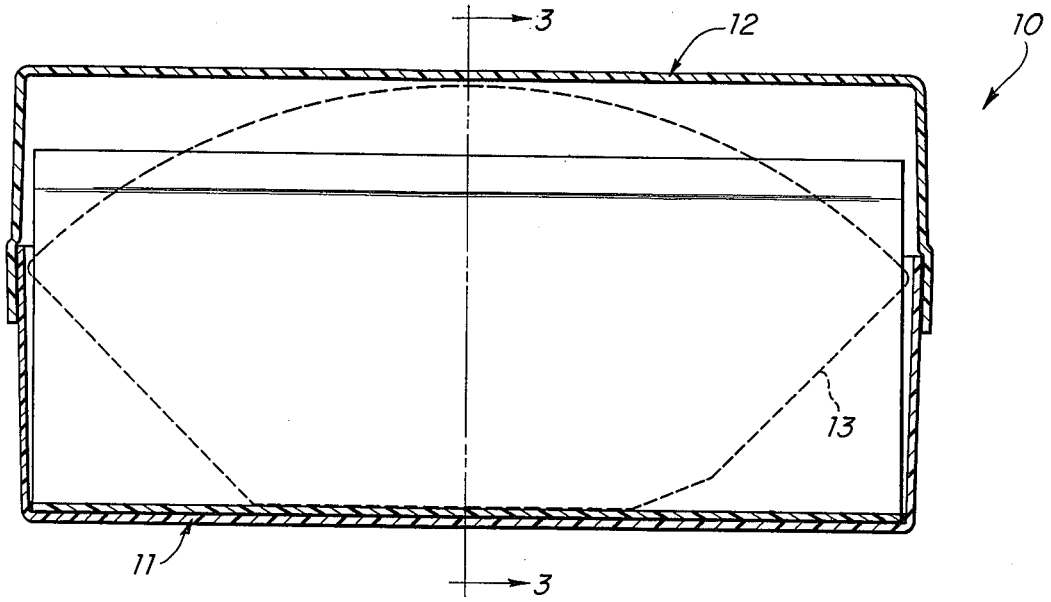
FIG. 1 illustrates, in cross-section, the font segment container according to a presently preferred embodiment of the present invention looking in the directions of arrows 1—1 in FIG. 3.

FIG. 1 illustrates the protective font segment container or package according to a presently most preferred embodiment of the invention. The container is generally designated by reference number 10 and includes a housing portion 11 of generally rectangular shape, and a cap portion 12 adapted to close the housing portion 11 after insertion of the font segment therein. As illustrated in dotted lines in FIG. 1, the font segment 13 to be held in the container is roughly in the form of a quadrant of a circle having an axial portion removed. The segment preferably fits into the container with its curved edge up, as illustrated, although this is not essential.

Figure 2:
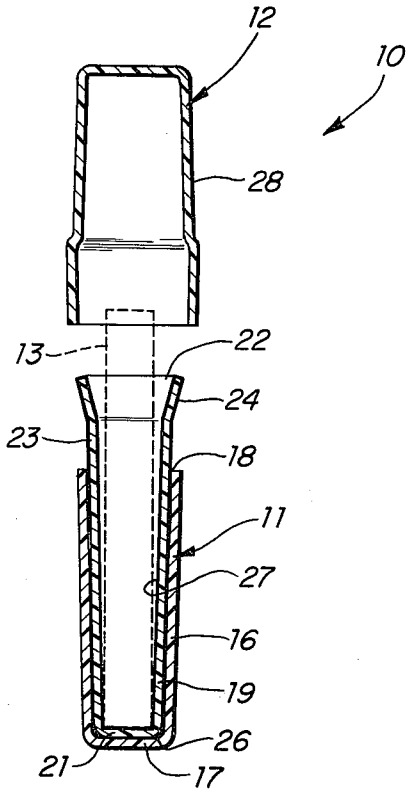
FIGS. 2 and 3 illustrate the font segment container in cross-section looking in the direction of the arrows 3—3 in FIG. 1, with FIG. 2 illustrating the container in an open condition and FIG. 3 illustrating the same container in a closed condition.
Figure 3:
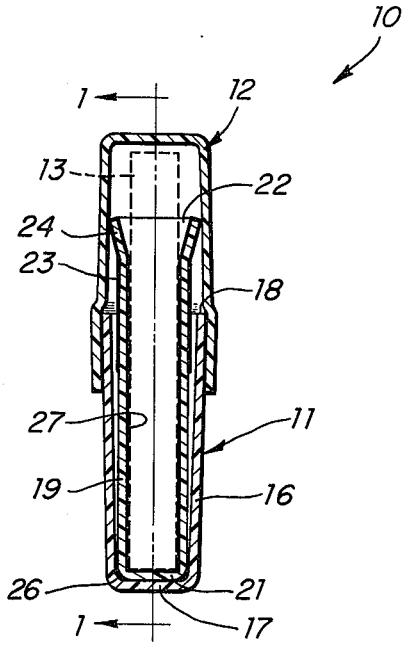

FIGS. 2 and 3 illustrate the structural details of the container. These FIGS. illustrate the container in cross-section, with FIG. 2 showing the housing and cap portions separated and FIG. 3 showing them coupled together.

As shown more clearly in these FIGS., the housing portion 11 consists of an outer casing 16 having a closed bottom end 17, and an open top end 18, and an inner casing 19 supported within the outer casing in generally mating relationship, and also having a closed bottom end 21 and an open top end 22. As illustrated, both casings are of generally U-shaped cross-section with a slight taper toward their bottom ends. Also, the inner casing 19 is somewhat longer than the outer casing 16 and, accordingly, has side wall portions 23 which extend out of and beyond the top opening 18 of outer casing 16. Extended wall portions 23 are also slightly deformed outwardly at their ends 24 for cooperating with cap portion 12 as will be explained hereinafter.

Both inner and outer casings 16 and 19 are preferably constructed of plastic materials, and, for convenience, can both be of the same material. ABS plastic is the presently most preferred material because it can be easily vacuum formed to the desired shape and also because it is somewhat flexible for reasons to be explained below. It should also be noted that inner casing 19 is cemented to outer casing 16 adjacent their bottom ends as illustrated by cement 26, but are not physically coupled along their side walls so that they are capable of being separated relative to one another.

Completing the housing portion 11 is an inner felt lining 27 covering the inner surface of inner casing 19. Felt lining 27 is provided to protect the font segment against surface damage and is preferably wrapped around the extended side wall portions 23 of inner casing 19 as illustrated.

Font segment 13 is adapted to be inserted into housing portion 11 and, as shown in FIG. 2, will fit into the inner casing with a positive clearance fit, i.e., it will fit easily into the inner casing with a clearance between it and the side walls of the casing. This will minimize the risk of the segment being scratched or marred by rubbing against any debris that might be present in the casing. This loose fit, however, is not suitable for storage or handling of the segment and, to effectively protect it, cap portion 12 (preferably also formed of ABS plastic) is provided to close the housing portion 11 and also to cooperate with inner casing 19 to positively lock the segment in position in the housing. Specifically, cap 12 includes a depending side wall or flange 28 designed to fit over and surround extended side wall portions 23 of inner casing 19. In doing so, however, it will contact deformed projections 24 on inner casing 19 and press them inwardly. Because of the relative flexibility of inner casing 19, and also because its side walls are not secured to outer casing 16, the entire inner casing will tend to be pushed inwardly away from outer casing 16 and into contact with the font segment and lock it rigidly against movement. Further downward movement of the cap portion will cause it to also close around outer casing 16 and it will remain in the locked position of FIG. 3, in part, due to the pressure applied against it by projections 24.

To remove the segment from the housing it is only necessary to lift the cap portion up and away from the housing portion. This will free the walls of the inner casing and allow them to spring outwardly and release the font segment.

As a further aspect of the invention, it should be noted in FIGS. 2 and 3 that the font segment actually extends a slight distance, e.g., ½ inch, above the top of inner casing 19. Accordingly, in removing the segment from the housing only that extended portion can be touched. Since the font-containing areas of the segment are below this extended portion of the segment, the casing is designed to make it unnecessary to touch the sensitive areas of the segment at any time. This helps to protect the segment against surface damage during insertion and removal from the housing.

In the presently most preferred embodiment, wherein the font segment comprises roughly a quadrant of a 9 inch diameter disc, the dimensions of the container are as follows: the inner and outer casings 19 and 16 are about 1/16 inches thick vacuum formed ABS plastic. The felt layer is approximately 1/32 of an inch thick. The inner casing 19 extends above the outer casing for a distance of about ½ inch. In general, the present invention provides a very simple container which can be constructed very inexpensively and, yet, is effective in protecting the delicate font segments during transport and storage. Although what has been described is a presently most preferred embodiment, it should be recognized that the invention could take other forms. For example, the container of the present invention may find application in protecting and holding a wide variety of other types of objects which must be protected against breakage and surface damage. Obviously, the shapes of such articles, and, hence of the protective package may vary within wide ranges.

Since many addition, omissions and changes can be made without departing from the scope of the present invention, it should be understood that the present invention should be limited only insofar as required by the scope of the following claims.

What is claimed is:

1. A protective container for delicate objects, said container comprising:

a. a housing portion for receiving an object, said housing portion including:
   1. an outer casing; and,
   2. an inner casing supported within said outer casing, said inner casing having projecting wall means extending through an opening in one end of said outer casing, said projecting wall means defining an opening for insertion of said object into said inner casing; and, b. a cap portion for closing said housing portion, said cap portion including flange means for surrounding said projecting wall means of said inner casing and for forcing said projecting wall means inwardly into contact with said object for locking said object against movement within said container wherein said outer casing includes side walls which are normally in contact with said side walls of said inner casing, and wherein said flange means of said cap portion cooperates with said projecting wall means of said inner casing for forcing the side walls of said inner casing away from the side walls of said outer casing and against said object.

2. A container as recited in claim 1 wherein said inner casing includes side walls for defining a cavity for receipt of said object, said cavity being sized to receive said object with a positive clearance fit with respect to said side walls, and wherein said flange means of said cap portion cooperates with said projecting wall means for forcing said side walls of said inner casing inwardly against said object for substantially eliminating said clearance.

3. A container as recited in claim 2 wherein said inner casing is constructed of relatively flexible material whereby upon removal of said cap portion, said side walls of said inner casing will return into contact with said side walls of said outer casing and away from said object for ease in removal of said object from said housing portion.

4. A container as recited in claim 3 and further including coupling means for rigidly coupling said outer casing to said inner casing at the end thereof opposite said opening.

5. A container as recited in claim 1 and further including a soft protective lining for covering the inner surface of said side walls of said inner casing.

6. A container as recited in claim 5 wherein said protective lining comprises a felt lining.

7. A protective container for font disc segments comprising:

a. a housing portion for receiving said segment, said housing portion including:
   1. an outer casing having side walls for defining an opening at one end thereof; and,
   2. an inner casing supported within said outer casing, said inner casing having side walls normally in contact with said side walls of said outer casing, the side walls of said inner casing further including projecting wall means extending through and beyond said opening in said outer casing, said projecting wall means also defining an opening for insertion of said segment into said inner casing; and, b. a cap portion for closing said housing portion, said cap portion including flange means for surrounding said projecting wall means of said inner casing and for forcing the side walls of said inner casing away from the side walls of said outer casing thereby forcing said projecting wall means inwardly against said segment for locking said segment against movement within said container.

8. A container as recited in claim 7 wherein said segment normally fits within said inner casing with a positive clearance fit with respect to said side walls of said inner casing, and wherein said flange means cooperates with said projecting wall means for forcing said side walls of said inner casing away from said side walls of said outer casing and against said segment for locking said segment against movement within said container.

9. A container as recited in claim 8 and further including means for rigidly coupling said outer casing to said inner casing at the end thereof opposite said open end.

10. A container as recited in claim 7 and further including protective lining means for covering the inner surface of said side walls of said inner casing.

11. A container as recited in claim 8 wherein said inner casing is constructed of relatively flexible material whereby upon removal of said cap portion, said side walls of said inner casing will return into contact with said side walls of said outer casing and away from said segment for ease in removal of said segment from said housing portion.

* * * * *